US005816295A

United States Patent [19]

Sugita et al.

[11] Patent Number: 5,816,295

[45] Date of Patent: Oct. 6, 1998

[54] WEFT INSERTION CONTROL METHOD

[75] Inventors: Katsuhiko Sugita; Tsutomu Sainen; Isamu Yamashita, all of Kanazawa, Japan

[73] Assignee: Tsudakoma Kogyo Kabushiki Kaisha, Kanazawa, Japan

[21] Appl. No.: 800,295

[22] Filed: Feb. 13, 1997

[30] Foreign Application Priority Data

Feb. 14, 1996 [JP] Japan ..... 8-050974

[51] Int. Cl.[6] ..... D03D 47/30

[52] U.S. Cl. ..... 139/435.2; 139/435.5

[58] Field of Search ..... 139/1 E, 435.2, 139/435.3, 435.5, 1 R; 364/470.11

[56] References Cited

U.S. PATENT DOCUMENTS

| | | | |
|---|---|---|---|
| 4,658,865 | 4/1987 | Gotoh | 139/435.2 |
| 4,732,179 | 3/1988 | Takegawa | 139/435.2 |
| 4,830,063 | 5/1989 | Takegawa | 139/435.2 |
| 5,067,527 | 11/1991 | De Jager | 139/435.2 |
| 5,176,184 | 1/1993 | Yamada | 139/435.2 |

FOREIGN PATENT DOCUMENTS

| | | |
|---|---|---|
| 279 222 | 8/1988 | European Pat. Off. . |
| 306 998 | 3/1989 | European Pat. Off. . |
| 464 557 | 1/1992 | European Pat. Off. . |
| 554 221 | 8/1993 | European Pat. Off. . |
| 3-40836 | 2/1991 | Japan . |
| 3-50019 | 7/1991 | Japan . |

*Primary Examiner*—Andy Falik
*Attorney, Agent, or Firm*—Wenderoth, Lind & Ponack, L.L.P.

[57] ABSTRACT

A weft picking control method capable of realizing control of a weft picking arriving time with a quick response over a wide range. The weft picking control method in an air-jet loom includes supplying air under pressure to weft picking nozzles, and jetting air under pressure from the weft picking nozzles so as to pick a weft into a warp shed together with the jetted air. Also, a supply passage for supplying the pressurized air to the weft picking nozzles includes high and low pressure supply passages. The passages are arranged in parallel with each other, and the air under pressure is jetted from the weft picking nozzles in cooperation with the two supply passages. A deviation between a weft arrival time of the picked weft and a reference weft arrival time is detected during the weft picking operation, and time for jetting air under high pressure and a weft picking starting time are respectively changed so as to reduce the deviation to zero on the basis of the detected deviation in the next and succeeding weft picking operations.

14 Claims, 12 Drawing Sheets

WEFT INSERTION CONTROL METHOD

BACKGROUND OF THE INVENTION

1. Field of the Invention

The present invention relates to a method of controlling a weft arrival time in an air-jet loom by changing a time for jetting air under pressure or a weft insertion starting time based on a deviation of weft arrival time.

2. Prior Art

JP-A 3-40836 discloses a method of controlling a turning angle of a main shaft at which a weft insertion starts (hereinafter referred to as a weft starting angle) for fixing the turning angle of the main shaft at which the weft arrives in a predetermined position (hereinafter referred to as weft arriving angle), and of controlling a pressure of air jetted through picking nozzles on the basis of a deviation of the weft arriving angle when the weft starting angle reaches a limit.

According to the above technique, a response characteristic of a pressure control is low since it takes time for changing the jetted air pressure. Accordingly, although a control range is widened by regulating two control elements, i.e., the weft insertion starting angle and the pressure of the jetted air, it is difficult to maintain a quick response extending to the entire control range.

Further, JP-B 3-50019 discloses a control of a weft arrival time by providing two pressurized air supply systems (i.e. air under high pressure and air under low pressure) to a main nozzle, and by changing period (starting and ending time) for jetting the air under pressure in response to a high or low speed of a weft which is detected at an early time or stage of the weft picking. The detection of the speed of the picked weft and the change of the jetting period are respectively performed in the same weft picking cycle.

According to the aforementioned techniques, the weft does not reach the predetermined position at an accurate time since the jetting period is changed on the basis of the initial weft picking speed. That is, since it is necessary to detect the weft picking speed at an early stage of the weft insertion operation, thereby calculating the control amount and then changing the jetting period, the high pressure jetting period can not be set to a long one, and further the control range is narrowed because the control is performed only by the high pressure jetting period.

In any of the above techniques, the problems of slow control response and narrow control range remain, thereby making it impossible to realize a suitable control for a variety of wefts.

SUMMARY OF THE INVENTION

It is therefore an object of the present invention to provide a weft picking control method capable of controlling a weft picking arriving time in a quick response over a wide range.

To achieve the above object, the weft picking control method in an air-jet loom, according to a first aspect of the invention, comprises supplying air under pressure to weft picking nozzles, jetting air under pressure from the weft picking nozzles so as to pick a weft into a warp shed together with the jetted air under pressure. A supply passage for supplying the air under pressure to the weft picking nozzles comprises high and low pressure air supply passages which are arranged in parallel with each other. Also, a deviation between an arriving time of the picked weft and a reference weft arrival time is detected during the weft picking operation, and time for jetting air under pressure and a weft picking starting time are respectively changed so as to reduce the deviation to zero on the basis of the detected deviation.

The change of the jetting period and that of the weft picking starting time are carried out by changing the jetting period when the weft picking starting time reaches a control limit, or by changing the weft picking time when the jetting period reaches the control limit, or by changing both of the jetting period and the weft picking time at the same time.

The weft picking nozzle to be controlled is a main nozzle alone, or sub-nozzles alone or both a main nozzle and sub-nozzles. The weft arrival time is a time when a tip end of the weft reaches a predetermined position (an arrival position opposite to the weft picking position, or a predetermined arrival position in a warp shed) of a weft picking passage or time when the weft is released from a measuring and storing drum by a predetermined amount (length of the weft by one pick or less than one pick), and these times are detected as a turning angle of a main shaft.

The change of the jetting period is carried out by changing jetting start timing, or by changing jetting end timing, or by changing both of the jetting start and end timings, or by changing a pulse rate of pulses in the case of pulse jetting.

The weft picking starting time is determined by the change of the low pressure jetting start timing or the time for releasing the weft from a measuring and storing device, in other words, by the change of release timing.

Since the control period for jetting air under high pressure and that of the weft picking starting time are respectively carried out by the timing changes, the control can be performed in a quick response, and the weft picking control can be performed rapidly over a wide range by employing both controls, thereby realizing a stabilized weft picking operation.

PREFERRED EMBODIMENT OF THE INVENTION

Figure 1:
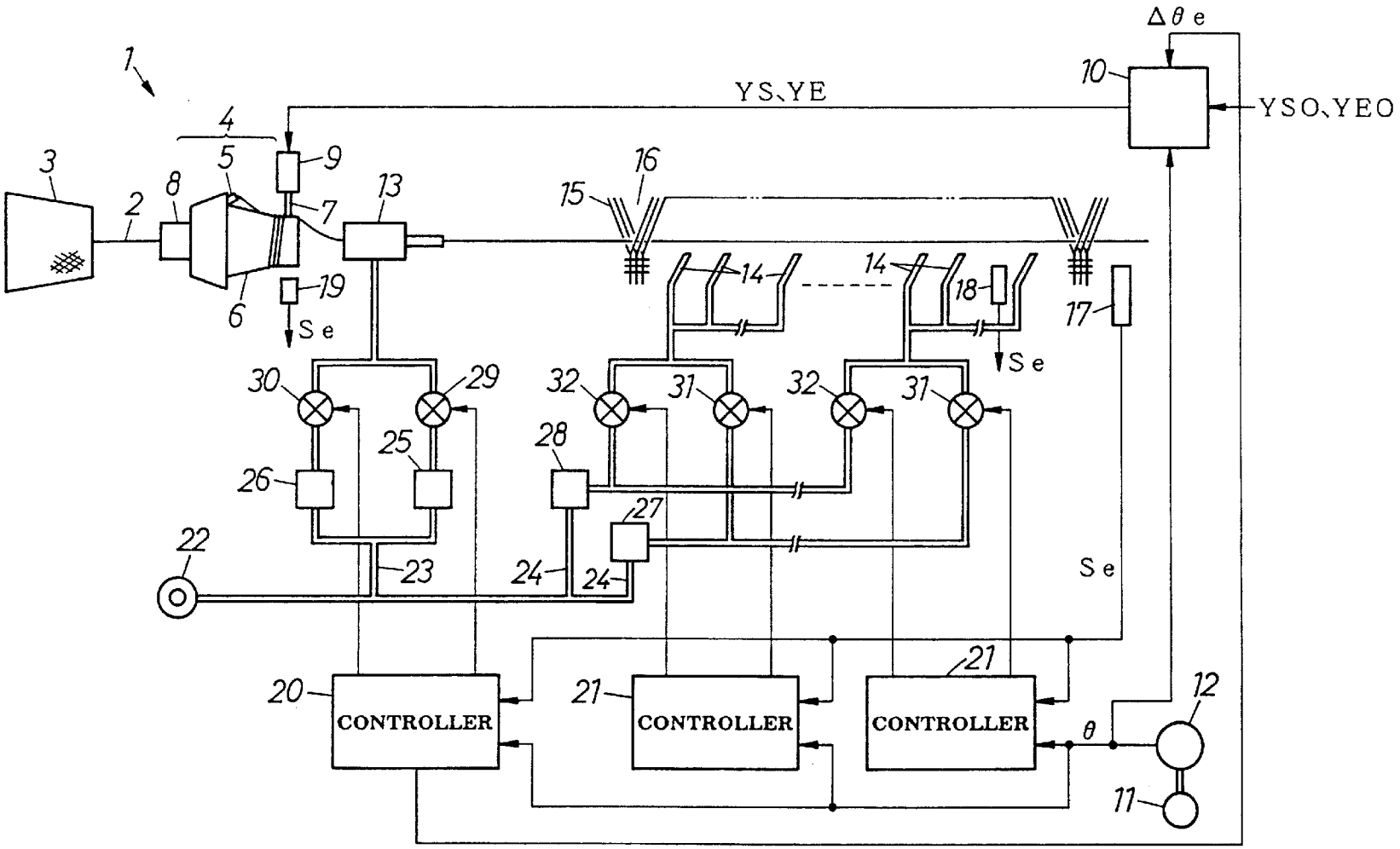
FIG. 1 is a block diagram of a weft picking apparatus.

FIG. 1 is a view schematically showing a weft picking apparatus 1 of an air-jet loom. A weft 2 is supplied from a yarn feeder 3, and it is measured by a length necessary for picking by one pick by a measuring and storing device 4, and then it remains stored on the measuring and storing device 4 until a weft picking starting time. That is, the measuring and storing device 4 is, for example, of a drum type for turning a turning yarn guide 5 along a circumference of a drum 6 by a motor 8, and winding the weft 2 around the circumferential surface of the drum 6 while retaining the weft 2 thereon by a retaining pin 7, thereby carrying out a measuring and storing operation.

At the weft picking starting time, the retaining pin 7 is moved backward by an operation device 9 in response to a release timing YS so that the weft 2 which is measured and stored on the circumferential surface of the drum 6 is released therefrom. At the same time, a main nozzle 13 serving as a weft picking nozzle draws the weft 2, which is released from the drum 6, so as to pick the weft 2 into each shed 16 of warps 15 together with air under pressure. A release controller 10 receives a signal representing a turning angle Θ from a turning detector 12 connected to a main shaft 11, a signal representing a deviation ΔΘe of a weft arrival time Se, a signal representing a reference release timing YSO and a signal representing a reference retention timing YEO, and it controls the movement of the retaining pin 7.

Accordingly, the weft 2 travels inside the shed 16 with the jetted air current. In this traveling passage, a plurality of groups of sub-nozzles 14 assist the traveling of the weft 2 by continuously jetting air under pressure along the traveling direction of the weft 2 during the traveling period as shown in FIG. 3 or sequentially jetting air under pressure in relays while conforming to a traveling distance D of the weft 2 as shown in FIG. 4.

Figure 3:
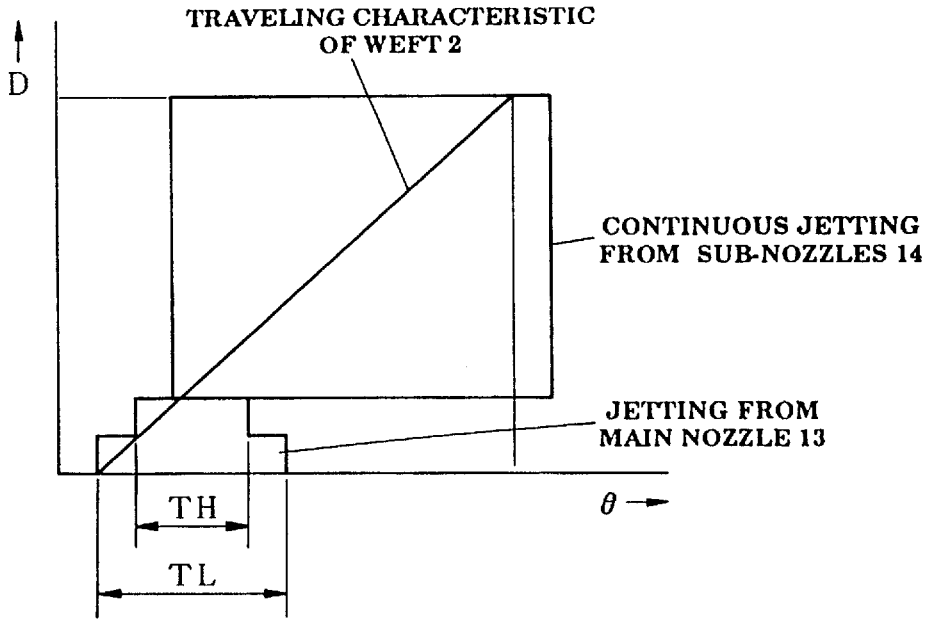
FIG. 3 is a view for explaining patterns for jetting air under pressure continuously from a main nozzle and sub-nozzles as weft picking nozzles.

As shown in FIG. 3, since the present invention is applied to the jetting operation of the main nozzle 13, the main nozzle 13 jets the air under low pressure during the low pressure jetting period LH and also jets the air under high pressure during the high pressure jetting period TH. Since the present invention is not applied to the jetting operation of the sub-nozzles 14 of all groups, all the sub-nozzles 14 perform the jetting operation continuously under a predetermined pressure during the same jetting period.

Figure 4:
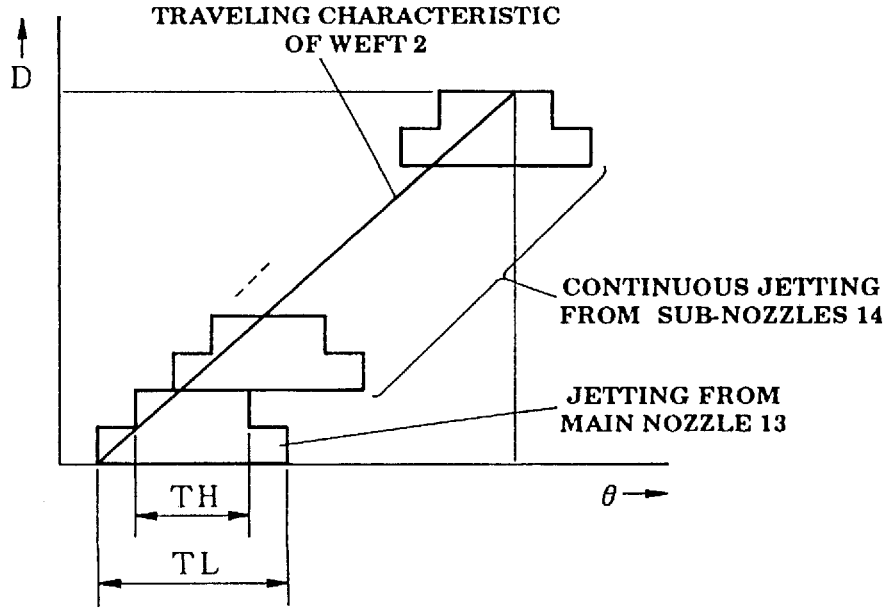
FIG. 4 is a view for explaining patterns for jetting air under pressure in relays from the main nozzle and the sub-nozzles as the weft picking nozzles.

Further, as shown in FIG. 4, since the present invention is applied to the main nozzle 13 and all sub-nozzles 14 of all groups, both the main nozzle 13 and the sub-nozzles 14 jet the air under low pressure during the low pressure jetting period TL while they jet the air under high pressure during the high pressure jetting period TH.

The jetting period of the sub-nozzles 14 of each group is set to be displaced or changed subsequently in accordance with the turning angle Θ to conform to the travelling speed of the weft.

Accordingly, the groups of sub-nozzles 14 perform relay jetting.

As mentioned above, the object to be controlled in jetting is the main nozzle 13 or sub-nozzles 14 or any of them.

When the tip end of the weft 2 reaches a predetermined position, it is detected by a yarn detector 17, for example, when the predetermined position is an arriving position of the tip end of the weft which is opposite to the weft picking position, and by a yarn detector 18 when the predetermined position is the inside of each shed 16 of the warps 15. Outputs of the yarn detectors 17 and 18 are respectively supplied to controllers 20 and 21 as signals of the weft arrival time Se.

The yarn detector 17 serves as a feeler for detecting an excellent or inferior condition of the weft picking. Since the prescribed position is proportional to a releasing length of the weft 2 (number of windings of the released weft 2), when the weft 2 reaches the predetermined position, the weft arrival time Se can be also detected as the releasing time of the prescribed winding by a yarn detector 19 which is positioned at a portion close to the drum 6 at the side of the measuring and storage device 4.

Air under pressure for weft picking is supplied from a pressurized source of air 22 to the main nozzle 13 through an air supply passage 23, pressure regulators 25 and 26 serving as tanks which are connected in parallel with each other, and solenoid valves 29 and 30. The air is also supplied to the sub-nozzles 14 through an air supply passage 24, pressure regulators 27 and 28 serving as tanks which are connected in parallel with each other, and solenoid valves 31 and 32.

The controllers 20 and 21 respectively receive the signal representative of the turning angle Θ, and the signal of the weft arrival time Se so as to control the solenoid valves 29, 30, 31 and 32, thereby changing a high pressure jetting period TH and an a picking starting time IS.

Figure 2:
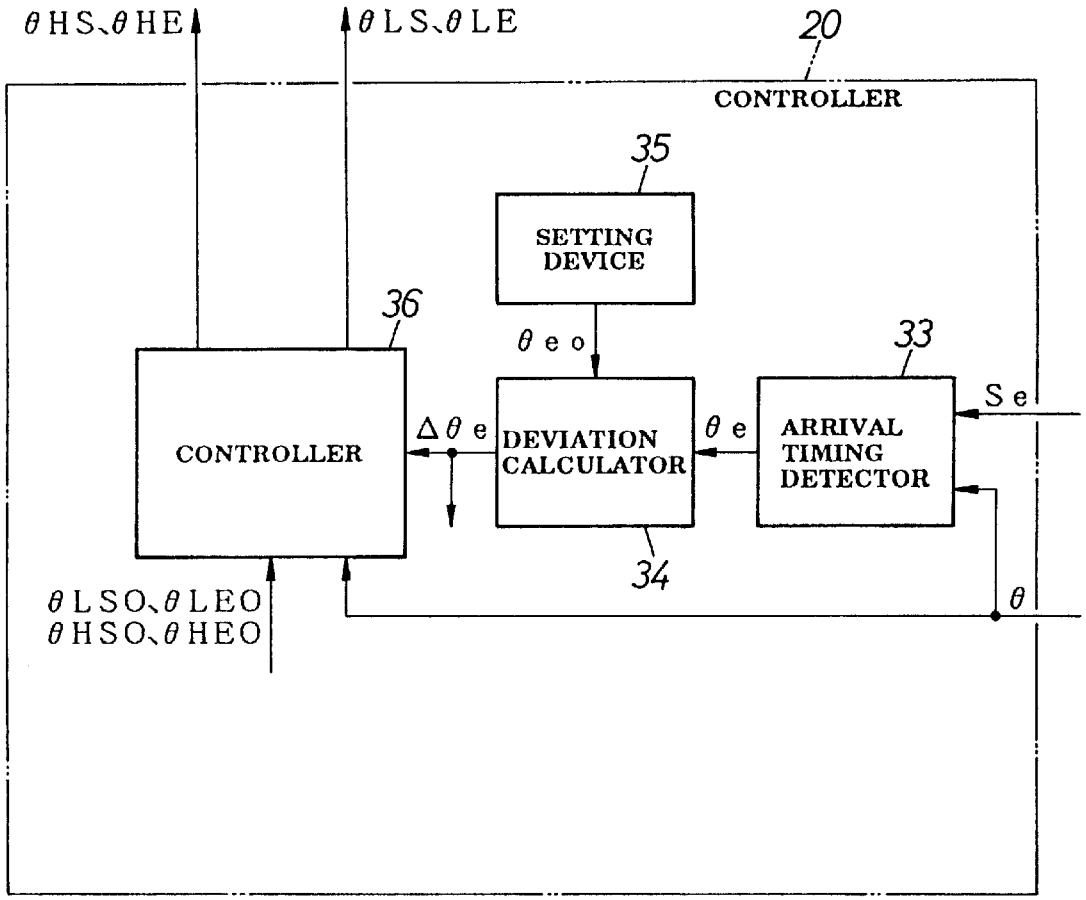
FIG. 2 is a block diagram of a controller.

FIG. 2 shows an internal structure of the controller 20. An arrival timing detector 33 receives the signal of the weft arrival time Se from, e.g., the yarn detector 17 and the signal of the turning angle Θ, and supplies the weft arrival time Se as the signal on the turning angle Θ, i.e., as an arrival timing Θe to a deviation calculator 34. The deviation calculator 34 compares a signal representing the arrival timing Θe with a reference weft arrival time, i.e., a target value Θeo decided by a setting device 35, thereby supplying the signal of the deviation ΔΘe to a controller 36.

The controller 36 adjusts an ON (open) timing, and an OFF (close) timing of the solenoid valves 29 and 30 upon reception of the signal of the turning angle Θ, the signal of the deviation ΔΘe, and a signal representing a reference high pressure jetting start (ON) timing ΘHSO, and a signal representing a reference high pressure jetting end (OFF) timing ΘHEO, a signal representing a reference low pressure jetting start (ON) timing ΘLSO, and a signal representing a reference low pressure jetting end (OFF) timing ΘLEO.

Each of the control devices 21 of the sub-nozzles 14 in each group is substantially similar to the controller 20 when the high pressure jetting period TH and the picking starting time IS are controlled.

The inside of the controller 36 is changed depending on a concrete modification of the high pressure jetting period TH and the picking starting time IS. The following concrete embodiments explain the control of the main nozzle 13, but they can be also applied to the control of the sub-nozzles 14 of each group. In each of the embodiments, an expression of TL≧TH is established between the low pressure jetting period TL and the high pressure jetting period TH.

Figure 5:
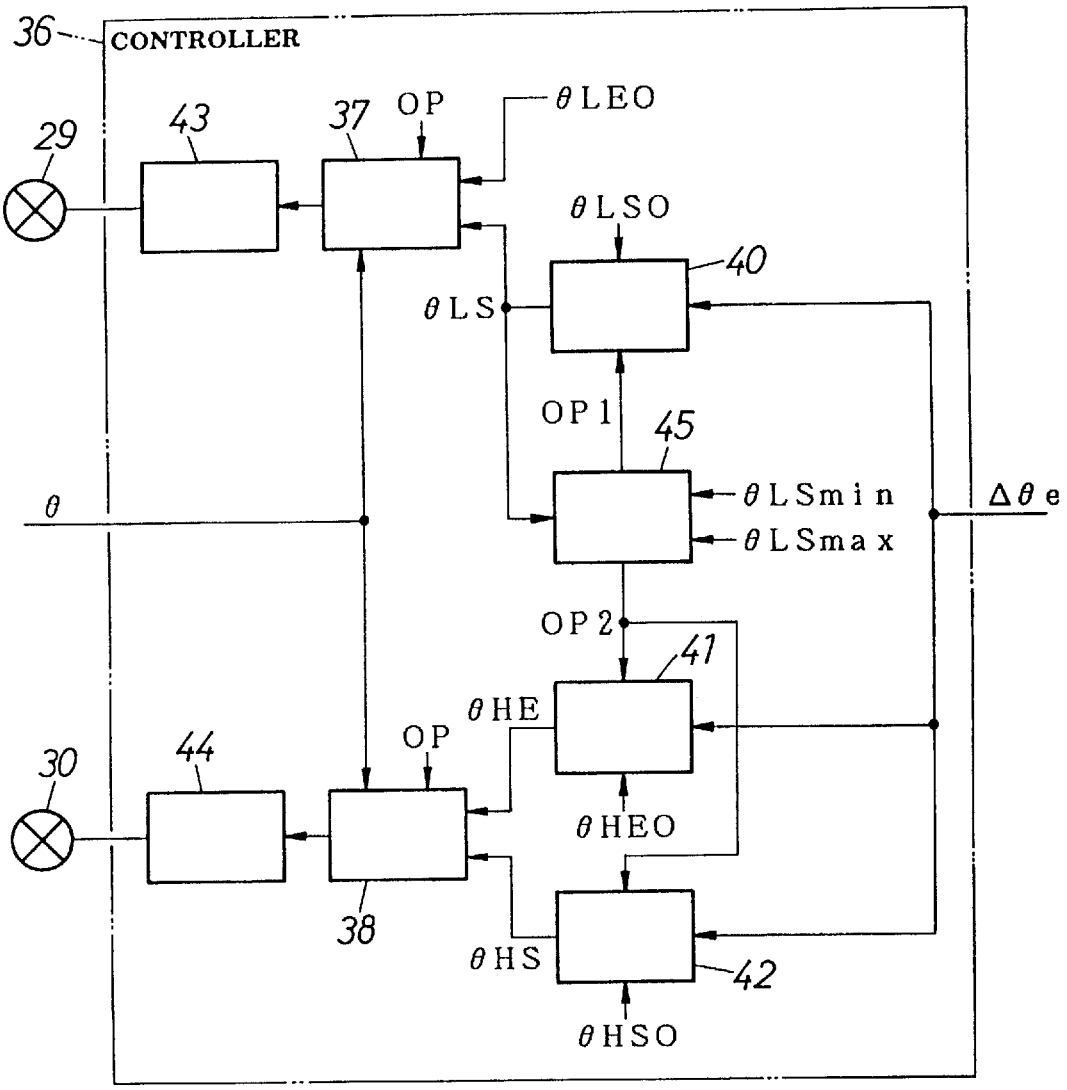
FIG. 5 is a block diagram showing an internal structure of a controller according to a first embodiment of the present invention.
Figure 6:
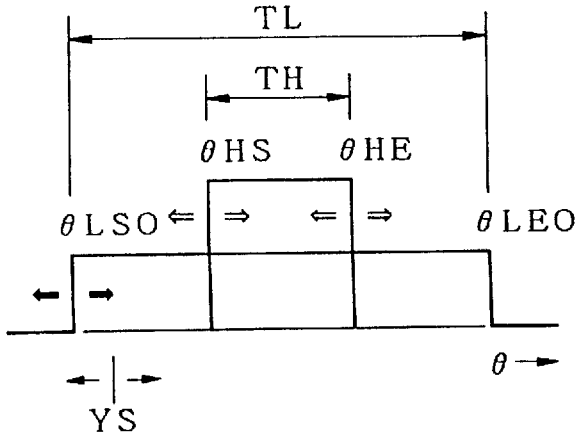
FIG. 6 is a view for explaining a pattern for jetting air under low pressure and another pattern for jetting air under high pressure according to the first embodiment shown in FIG. 5.

First Embodiment (FIGS. 5 and 6):

A first embodiment shown in FIGS. 5 and 6 relates to a case in which the picking starting time IS is changed so as to reduce the deviation ΔΘe to zero on the basis of the deviation ΔΘe of the weft arrival time Se, and for changing the high pressure jetting period TH so as to reduce the deviation ΔΘe to zero by changing the high pressure jetting start timing ΘHS and the high pressure end timing ΘHE when the amount of change reaches the limit. The change of the picking starting time IS is carried out by changing a low pressure jetting start timing ΘLS in the range of ΘLSmin to ΘLSmax.

Firstly, an output device 37 at the low pressure side opens the solenoid valve 29 by way of a driving amplifier 43 during the low pressure jetting period TL which is determined by the reference low pressure jetting start timing ΘLSO and the reference low pressure jetting end timing ΘLEO. An output device 38 at the high pressure side opens the solenoid valve 30 by way of an driving amplifier 44 during the high pressure jetting period TH which is determined by the reference high pressure jetting start timing ΘHSO and the reference high pressure jetting end timing ΘHEO. Accordingly, the solenoid valves 29 and 30 are opened during the time extending from the reference high pressure jetting start timing ΘHSO to the reference jetting end timing ΘHEO as shown in FIG. 6.

When the deviation ΔΘe occurs, a deciding device 40 at the low pressure side calculates a new low pressure jetting start timing ΘLS so as to reduce the deviation ΔΘe to zero under the existence of an operation command OP1 issued by an operation instruction device 45, and it outputs the new low pressure jetting start timing ΘLS to the output device 37 and the operation instruction device 45. At this time, since the operation instruction device 45 does not output an operation command OP2, the deciding devices 41 and 42 respectively output the reference high pressure jetting end timing ΘHEO and the reference high pressure jetting start timing ΘHSO. In such a manner, the picking starting time IS is changed to reduce the deviation ΔΘe to zero.

When the low pressure jetting start timing ΘLS reaches the limit, namely, an expression of ΘLSmin>ΘLS or an expression of ΘLSmax<ΘLS is established, the operation instruction device 45 stops outputting of the operation command OP1, then outputs the operation command OP2 to the deciding devices 41 and 42. Accordingly, the deciding device 40 holds the low pressure jetting start timing ΘLS at that time, and the deciding devices 41 and 42 respectively calculate a new high pressure end timing ΘHE and a new high pressure jetting start timing ΘHS so as to reduce the deviation ΔΘe to zero under the existence of the operation command OP2, then output these calculated timings ΘHE and ΘHS to the output device 38.

When the weft arrival time Se is earlier than the target value Θeo, the picking starting time IS is changed so as to delay the weft picking starting, while when the weft arrival time Se is later than the target value Θeo, the picking starting time IS is changed so as to quicken the weft picking starting.

When the weft arrival time Se is earlier than the target value Θeo even if the low pressure jetting start timing ΘLS reaches the limit, the deciding device 41 quickens the high pressure end timing ΘHE and the deciding device 42 delays the high pressure jetting start timing ΘHS so as to reduce the high pressure jetting period TH. On the other hand, when the weft arrival time se is slower than the target value Θeo, the deciding device 41 delays the high pressure end timing ΘHE and the deciding device 42 quickens the high pressure jetting start timing ΘHS so as to increase the high pressure jetting period TH. Suppose that the reference high pressure jetting start timing ΘHSO and the reference high pressure jetting end timing ΘHEO are respectively set so as not to reach the reference low pressure jetting start timing ΘLSO and the reference low pressure jetting end timing ΘLEO during the process of the change of the high pressure end timing ΘHE and the high pressure jetting start timing ΘHS.

Since the release timing YS is normally set to be the same as the reference low pressure jetting start timing ΘLSO or to be slightly later than the low pressure jetting start timing ΘLS, the picking starting time IS is substantially controlled by the release timing YS. However, when the release timing YS is set to be earlier than the low pressure jetting start timing ΘLS, the weft picking is not started even if the weft 2 is released from the measuring and storing device 4 since the low pressure air is not substantially jetted.

Accordingly, when the release timing YS is set to be earlier than the low pressure jetting start timing ΘLS, the picking starting time IS is substantially decided by the low pressure jetting start timing ΘLS. The release controller 10 adjusts the release timing YS so as to be quickened or delayed in response to the deviation ΔΘe with respect to the reference release timing YSO corresponding to the change of the low pressure jetting start timing ΘLS. It is needless to say that the reference release timing YSO is set to be earlier than the reference low pressure jetting start timing ΘLSO so that both timings may be changed by the same amount.

Further, the picking starting time IS may be changed by changing the delayed set timing alone if the amount of change is within aforementioned relative timings instead of changing the low pressure jetting start timing ΘLS and the release timing YS by the same amount, so that they become constant at their relative timing. For example, if the reference release timing YSO is set to be later than the reference low pressure jetting start timing ΘLSO, the picking starting time IS may be changed by changing the release timing YS alone. At this time, the lower limit release timing YSmin becomes the reference low pressure jetting start timing ΘLSO.

Figure 7:
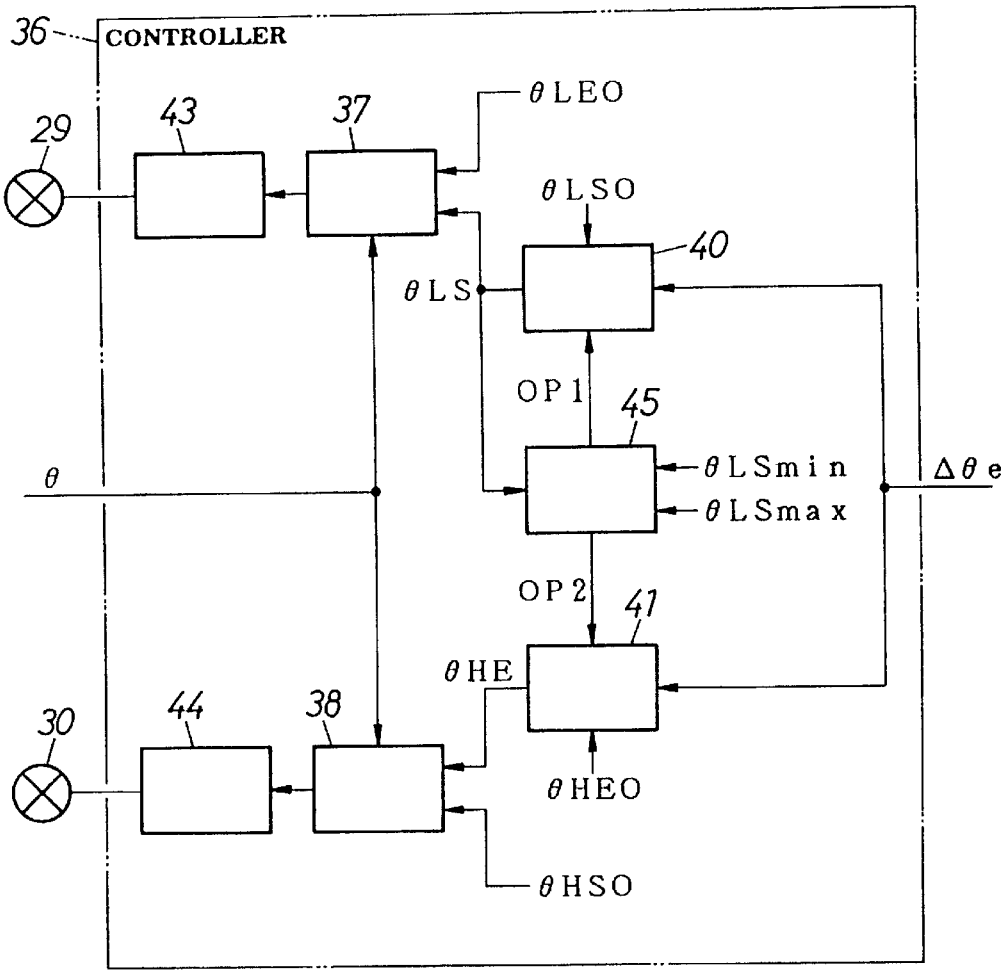
FIG. 7 is a block diagram showing an internal structure of a controller according to a second embodiment of the present invention.
Figure 8:
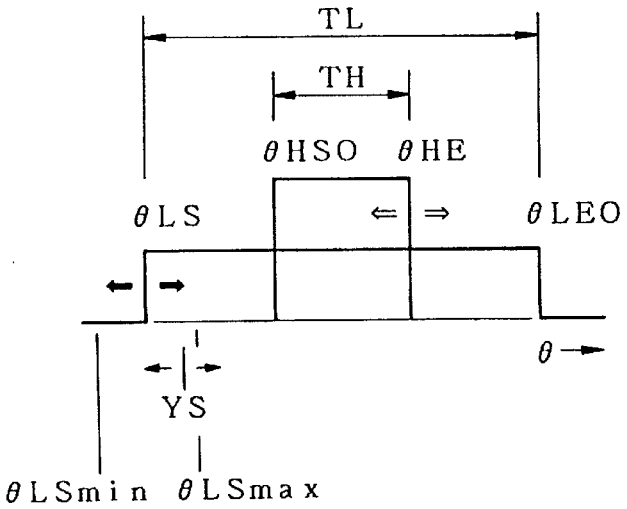
FIG. 8 is a view for explaining a pattern for jetting air under low pressure and another pattern for jetting air under high pressure according to the second embodiment shown in FIG. 7.

Second Embodiment (FIGS. 7 and 8):

A second embodiment shown in FIGS. 7 and 8 relates to a case in which the picking starting time IS is changed so as to reduce the deviation ΔΘe to zero by changing the low pressure jetting start timing ΘLS, and also changing the high pressure jetting period TH by changing the high pressure end timing ΘHE alone when the amount of change reaches the limit.

The deciding device 40 calculates a new low pressure jetting start timing ΘLS, and outputs the calculated low pressure jetting start timing ΘLS to the output device 37 and the operation instruction device 45 when the deviation ΔΘe occurs in the same manner as the first embodiment shown in FIG. 5. When the change of the low pressure jetting start timing ΘLS reaches the limit, the operation instruction device 45 stops outputting of the operation command OP1, and outputs the operation command OP2 to the deciding device 41. As a result, the deciding device 40 holds the low pressure jetting start timing ΘLS at that time, and the deciding device 41 calculates a new high pressure end timing ΘHE so as to reduce the deviation ΔΘe to zero under the existence of the operation command OP2, then outputs the calculated new high pressure end timing ΘHE to the output device 38. The change of the release timing YS is carried out in the same manner as the first embodiment.

In such a manner, the controller 36 changes the low pressure jetting start timing ΘLS preferentially, thereby changing the picking starting time IS so as to reduce the deviation ΔΘe to zero of the weft arrival time Se. Even if the controller 36 cannot adjust or reduce the deviation ΔΘe to zero, then it changes the high pressure jetting period TH in response to the remaining deviation ΔΘe.

Figure 9:
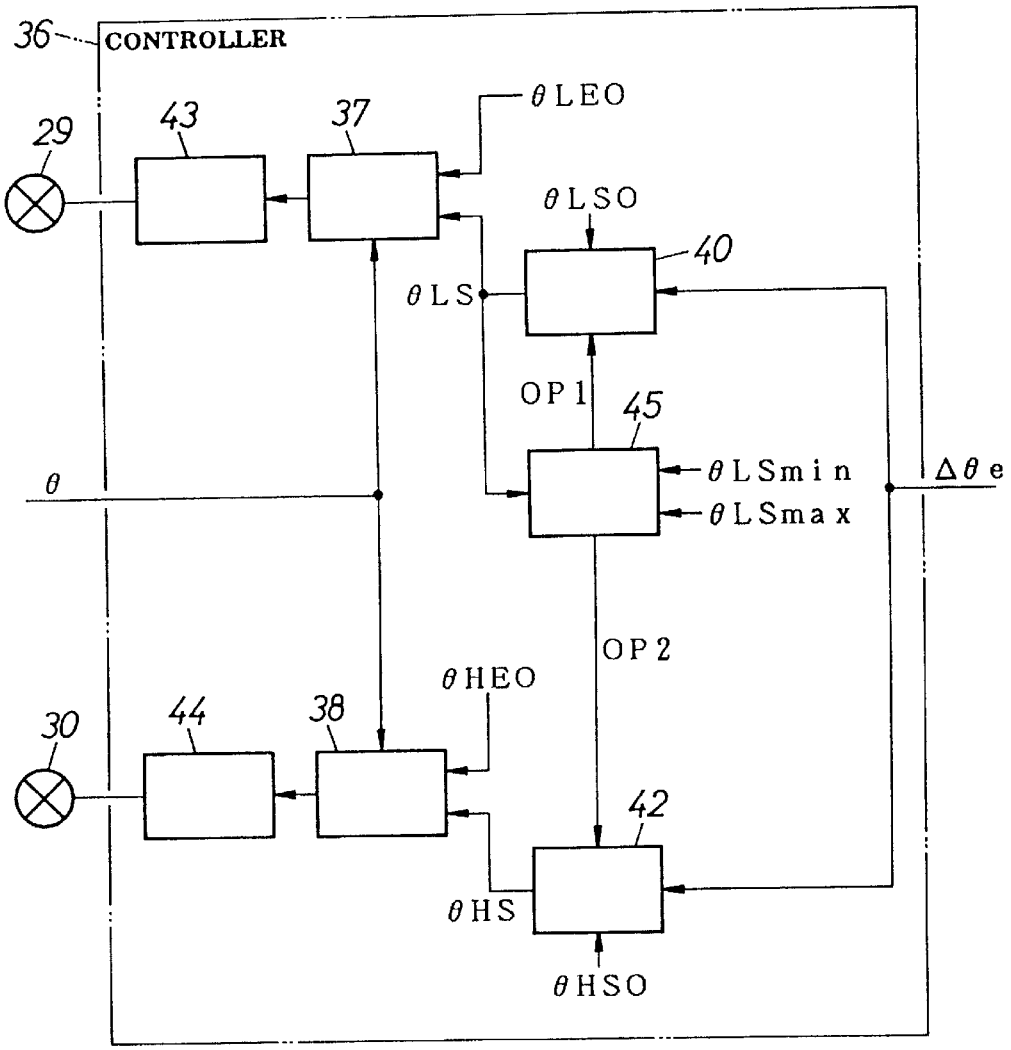
FIG. 9 is a block diagram showing an internal structure of a controller according to a third embodiment of the present invention.
Figure 10:
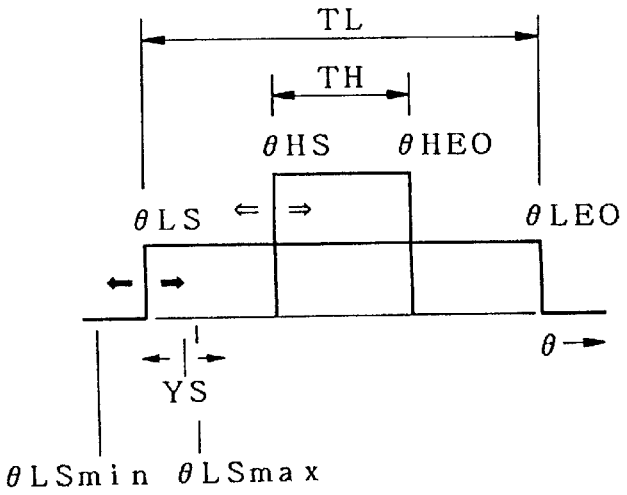
FIG. 10 is a view for explaining a pattern for jetting air under low pressure and another pattern for jetting air under high pressure according to the third embodiment shown in FIG. 9.

Third Embodiment (FIGS. 9 and 10):

A third embodiment shown in FIGS. 9 and 10 relates to a case in which the high pressure jetting start timing ΘHS is changed so as to reduce the deviation ΔΘe to zero although the second embodiment shown in FIGS. 7 and 8 relates to the case in which the high pressure end timing ΘHE is changed so as to reduce the deviation ΔΘe to zero. Accordingly, the high pressure end timing ΘHE is fixed to the reference jetting end timing ΘHEO. The function of the third embodiment is the same as the second embodiment.

Figure 11:
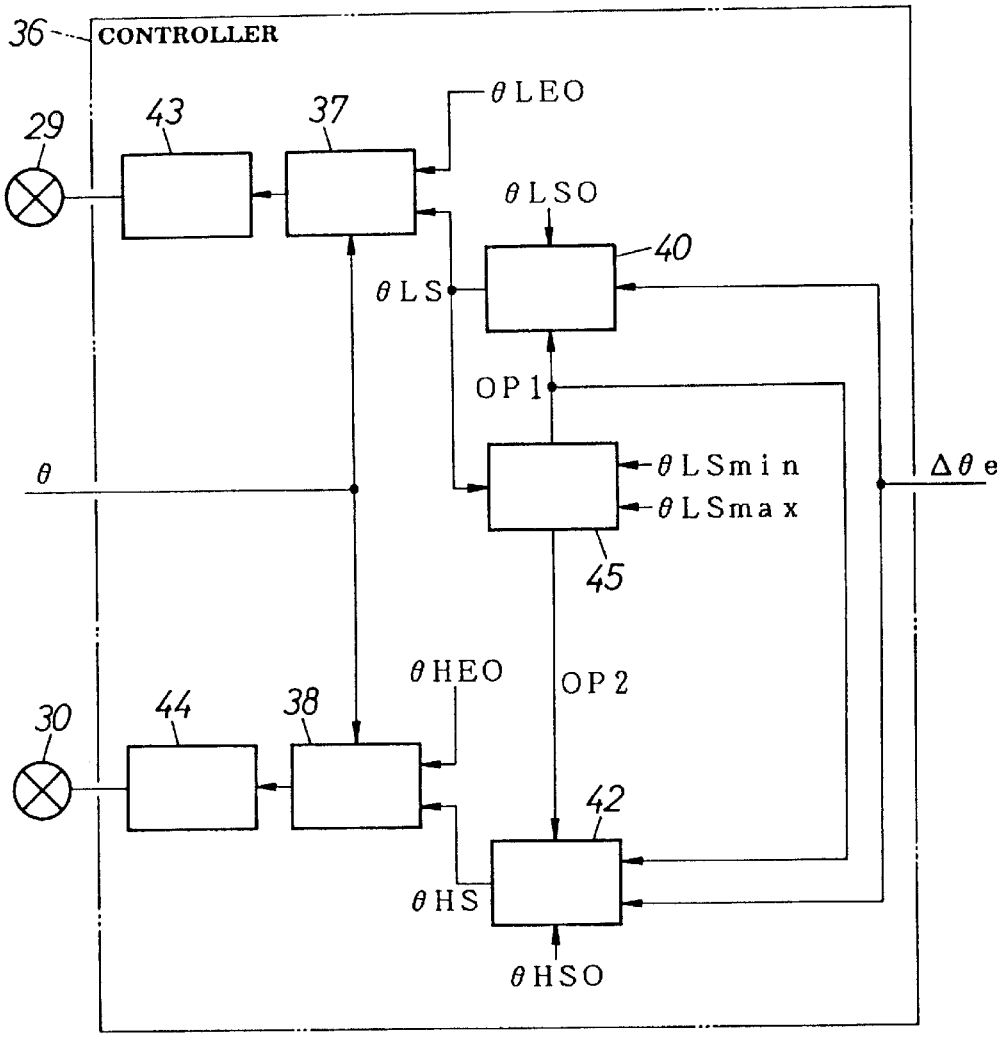
FIG. 11 is a block diagram showing an internal structure of a controller according to a fourth embodiment of the present invention.
Figure 12:
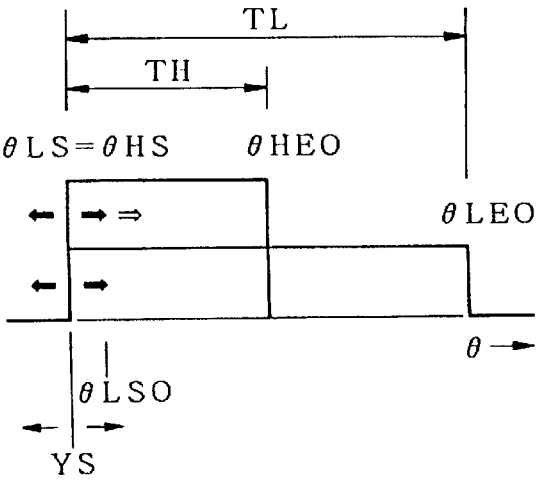
FIG. 12 is a view for explaining a pattern for jetting air under low pressure and another pattern for jetting air under high pressure according to the fourth embodiment shown in FIG. 11.

Fourth Embodiment (FIGS. 11 and 12):

A fourth embodiment shown in FIGS. 11 and 12 relates to a case in which the picking starting time IS is changed so as to reduce the deviation ΔΘe to zero by changing the low pressure jetting start timing ΘLS and the high pressure jetting start timing ΘHS at the same time by the same amount, and also changing the high pressure jetting start timing ΘHS alone so as to reduce the deviation ΔΘe to zero when the amount of change reaches the limit.

Since the high pressure jetting start timing ΘHS is changed so as to be delayed alone after the amount of change of the picking starting time IS reaches the limit in the fourth embodiment, it is advantageous that the fourth embodiment is applied to wefts which tend to increase in weft picking speed as the wefts on the yarn feeder 3 are consumed.

When the picking starting time IS is changed, the release timing YS is changed so as to always have the same value as the low pressure jetting start timing ΘLS. The reference low pressure jetting start timing ΘLSO and the reference high pressure jetting start timing ΘHSO at the early stages thereof are set to be the same value. The reference low pressure jetting end timing ΘLEO and the reference low pressure jetting end timing ΘHEO have the relation for establishing an expression of ΘLEO<ΘHEO, and hence they are fixedly set.

The deciding device 40 calculates the low pressure jetting start timing ΘLS so as to reduce the deviation ΔΘe to zero on the basis of the deviation ΔΘe under the existence of the operation command OP1 issued by the operation instruction device 45, and outputs the calculated low pressure jetting start timing ΘLS to the output device 37. At this time, the deciding device 42 calculates the high pressure jetting start timing ΘHS so as to reduce the deviation ΔΘe to zero under the existence of the operation command OP1, then outputs the calculated high pressure jetting start timing ΘHS to the output device 38.

When the low pressure jetting start timing ΘLS reaches the limit, the operation instruction device 45 stops outputting of the operation command OP1, and outputs the operation command OP2. Accordingly, the deciding device 40 holds the low pressure jetting start timing ΘLS at that time. On the other hand, the deciding device 42 reduces the deviation ΔΘe to zero by changing the high pressure jetting start timing ΘHS so as to delay the high pressure jetting start timing ΘHS alone under the existence of the operation command OP2.

Figure 13:
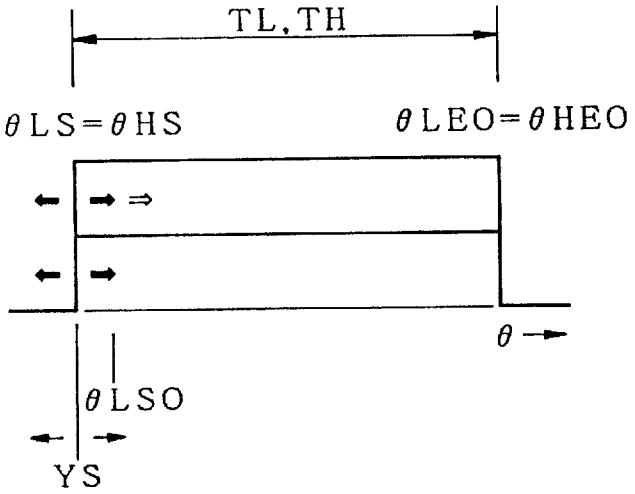
FIG. 13 is a view for explaining an air-jetting pattern for jetting air under low pressure and another pattern for jetting air under high pressure according to a fifth embodiment of the invention.

Fifth Embodiment (FIG. 13):

A fifth embodiment shown in FIG. 13 is a modification of the fourth embodiment shown in FIGS. 11 and 12, wherein the reference jetting end timing ΘHEO and the reference low pressure jetting end timing ΘLEO are conformed to each other but they are not changed.

Figure 14:
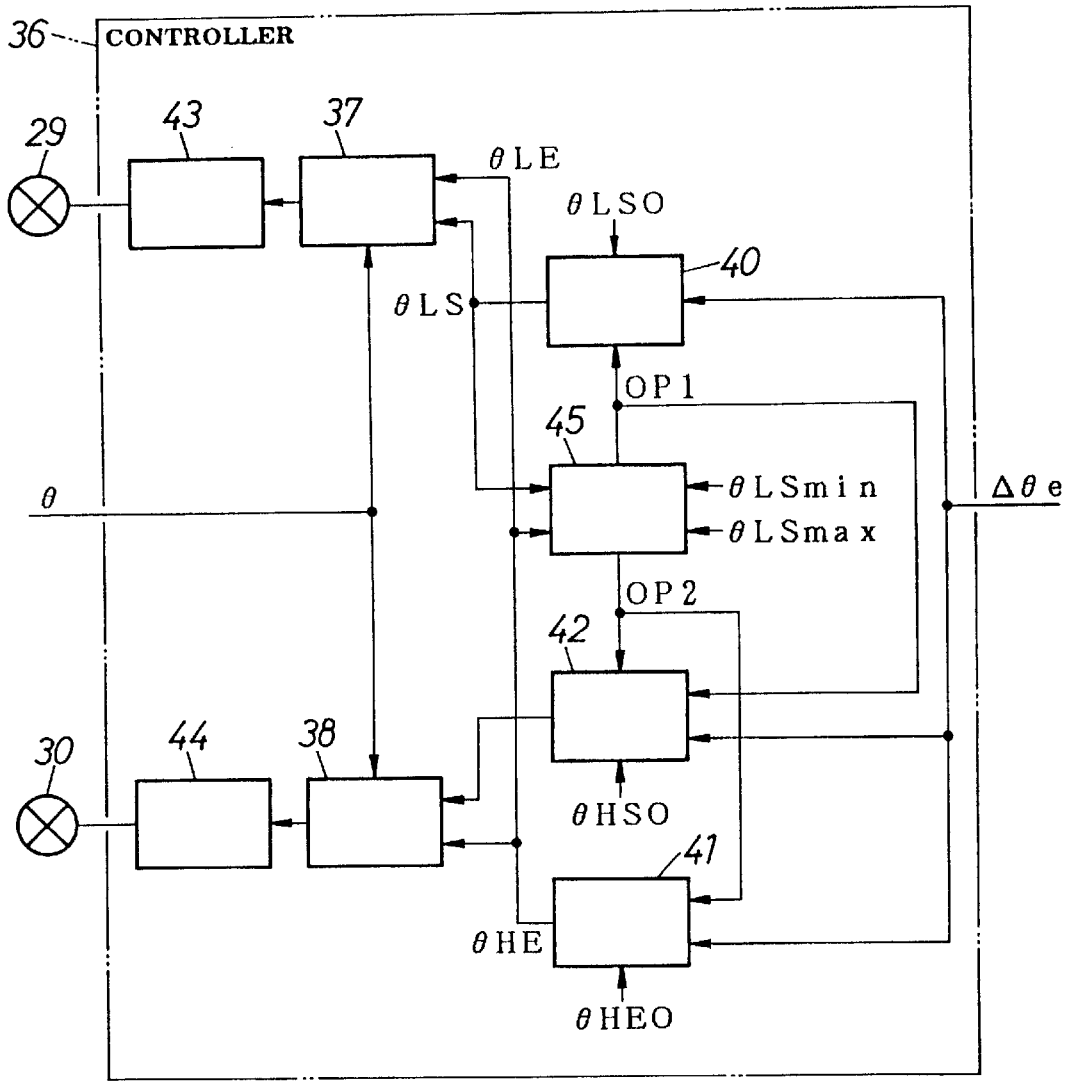
FIG. 14 is a block diagram showing an internal structure of a controller according to a sixth embodiment of the present invention.
Figure 15:
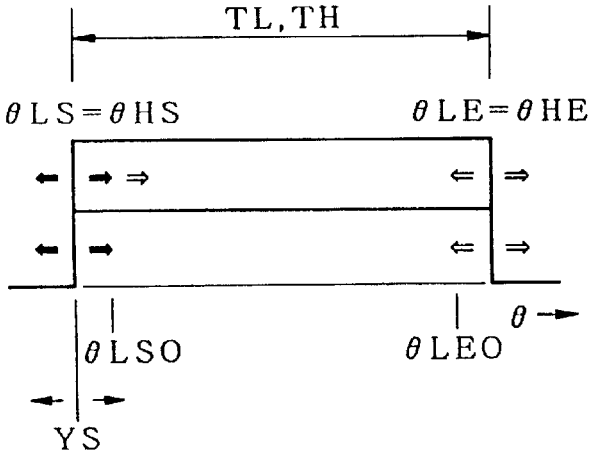
FIG. 15 is a view for explaining a pattern for jetting air under low pressure and another pattern for jetting air under high pressure according to the sixth embodiment of the invention.

Sixth Embodiment (FIGS. 14 and 15):

A sixth embodiment shown in FIGS. 14 and 15 relates to a case in which the picking starting time IS is changed so as to reduce the deviation ΔΘe to zero by changing the low pressure jetting start timing ΘLS and the high pressure jetting start timing ΘHS at the same time by the same amount, and for changing the high pressure jetting period TH so as to reduce the deviation ΔΘe to zero when the amount of change reaches the limit. The increase of the high pressure jetting period TH is carried out by delaying the high pressure jetting end timing ΘHE, and the decrease of the high pressure jetting period TH is carried out by delaying the high pressure jetting start timing ΘHS and by quickening the high pressure jetting end timing ΘHE.

The deciding device 40 calculates the low pressure jetting start timing ΘLS so as to reduce the deviation ΔΘe to zero under the existence of the operation command OP1, and outputs the calculated low pressure jetting start timing ΘLS to the output device 37 and the operation instruction device 45. At this time, the deciding device 42 calculates the high pressure jetting start timing ΘHS so as to reduce the deviation ΔΘe to zero under the existence of the operation command OP1, and outputs the calculated high pressure jetting start timing ΘHS to the output device 38.

When the low pressure jetting start timing ΘLS reaches the limit, the operation instruction device 45 stops outputting of the operation command OP1, and outputs the operation command OP2. The deciding device 40 holds the low pressure jetting start timing ΘLS at that time. The deciding device 42 changes the high pressure jetting start timing ΘHS so as to be delayed alone under the existence of the operation command OP2 on the basis of the deviation ΔΘe. The deciding device 41 changes the high pressure end timing ΘHE on the basis of the deviation ΔΘe under the existence of the OP2.

Figure 16:
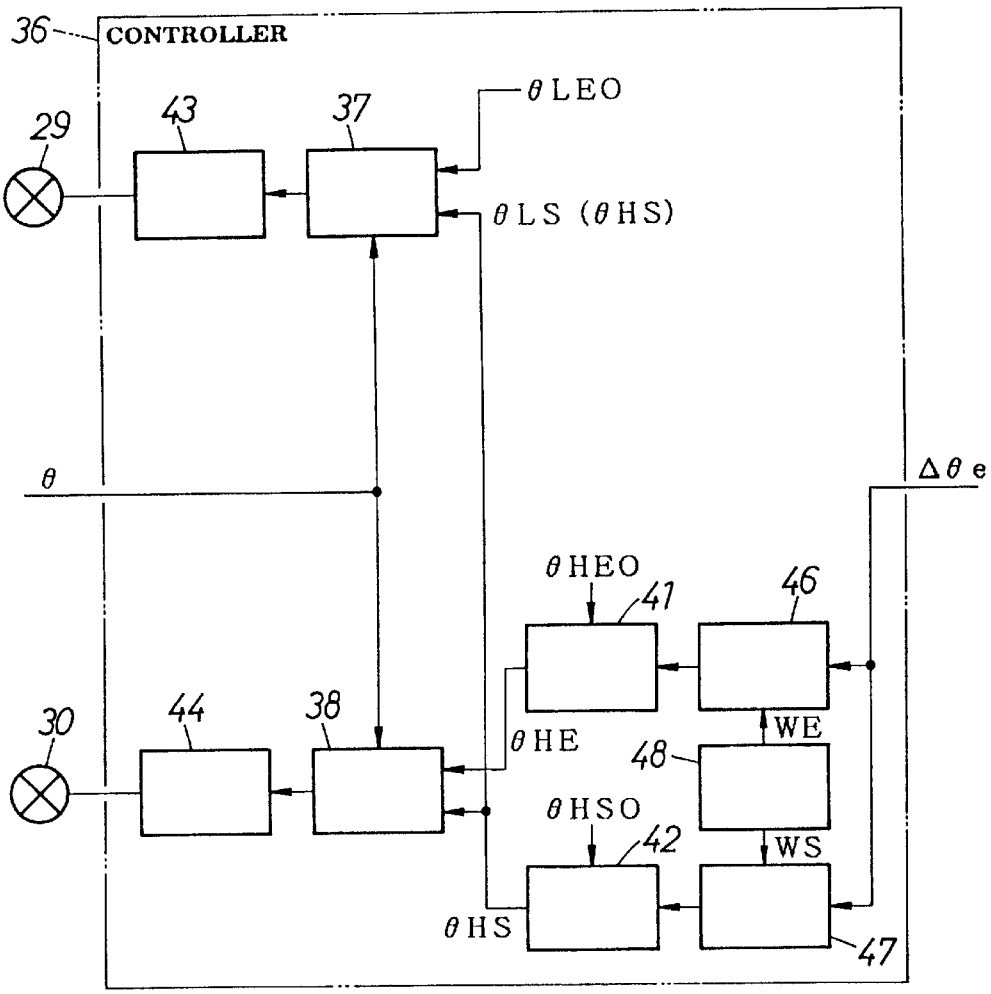
FIG. 16 is a block diagram showing an internal structure of a controller according to a seventh embodiment of the present invention.
Figure 17:
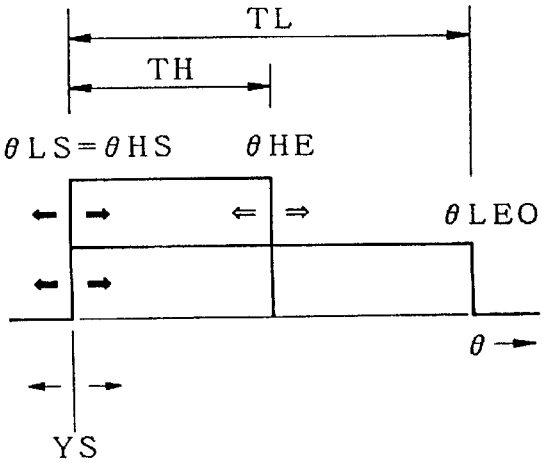
FIG. 17 is a view for explaining a pattern for jetting air under low pressure and another pattern for jetting air under high pressure according to the seventh embodiment of the invention.
Figure 18:
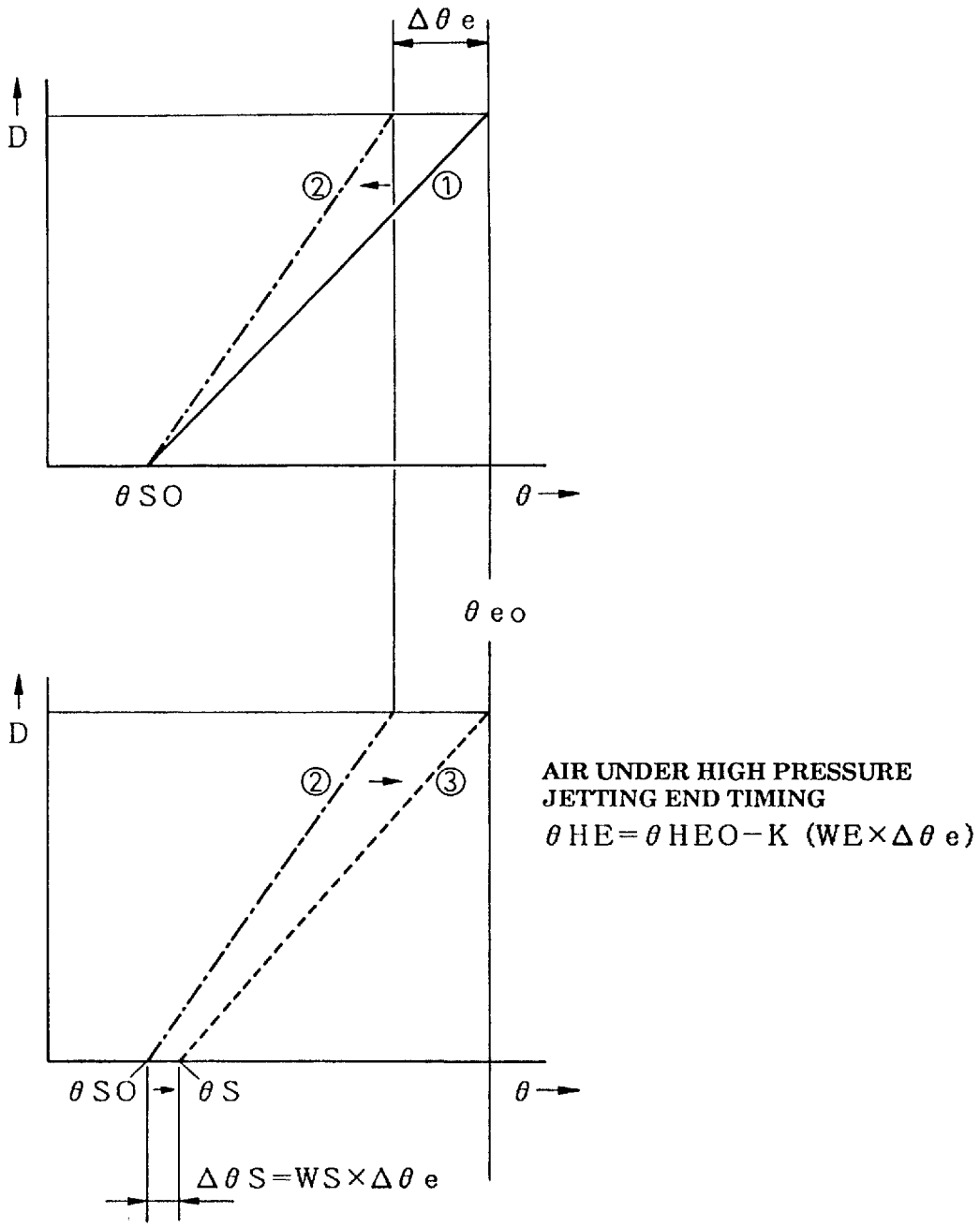
FIG. 18 is a view for explaining a setting of weighting according to the seventh embodiment of the invention.

Seventh Embodiment (FIGS. 16 through 18):

The seventh embodiment shown in FIGS. 16, 17 and 18 are examples in which the weft picking starting time IS and the high pressure jetting period TH are changed so as to reduce the deviation ΔΘe to zero on the basis of the deviation ΔΘe.

The change of the picking starting time IS is carried out by changing the low pressure jetting start timing ΘLS and the high pressure jetting start timing ΘHS and the release timing YS by the same amount while the change of the high pressure jetting period TH is carried out by the high pressure jetting end timing ΘHE. Further, when the deviation ΔΘe is divided by a predetermined ratio, the amount of change of the picking starting time IS and that of the high pressure jetting period TH are respectively weighted. Accordingly, dividers 46 and 47 are interposed on an input passage of the deviation ΔΘe wherein weight WS and WE, set by a setting device 48, are multiplied by the deviation ΔΘe.

Figure 19:
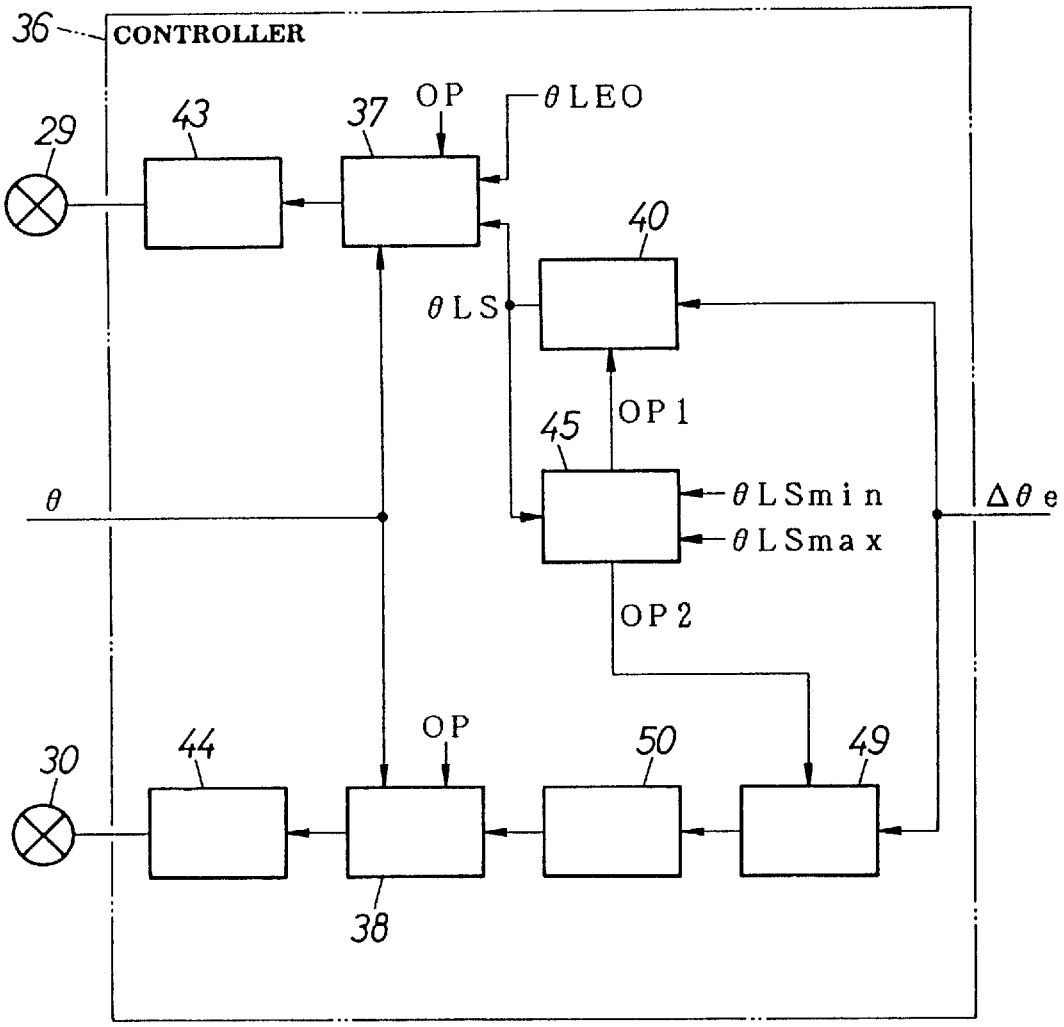
FIG. 19 is a block diagram showing an internal structure of a controller according to an eighth embodiment of the present invention.

A ratio (weights WS and WE) between the amount of change of the high pressure jetting start timing ΘHS and that of the high pressure jetting end timing ΘHE with respect to the deviation ΔΘe of the weft arrival time Se is determined by two formulas, i.e., ΔΘS=WS×ΔΘe, ΘHE=ΘHEO−K (WE×ΔΘe) based on the characteristic view in FIG. 19. The K is a conversion value for calculating the amount of change of the high pressure jetting period TH with respect to the divided deviation ΔΘe. In such a manner, the amount of change of the picking starting time IS and that of the high pressure jetting period TH with respect to the deviation ΔΘe of the weft arrival time Se are respectively corrected so as to be divided by the weights WS and WE. The formula for proportional division can be applied to the first to third and sixth embodiments in FIGS. 5, 7, 9 and 15.

Figure 20:
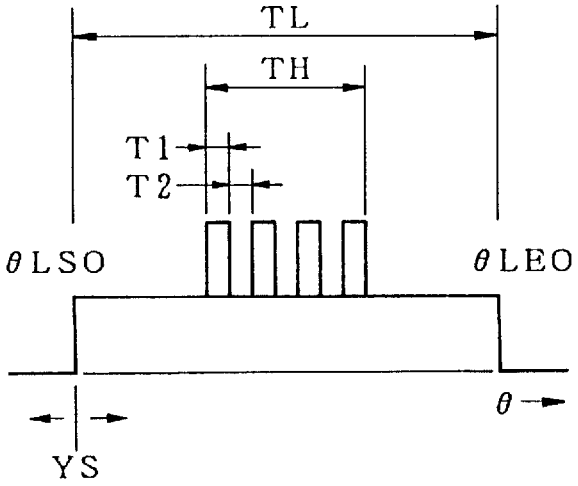
FIG. 20 is a view for explaining a pattern for jetting air under low pressure and another pattern for jetting air under high pressure according to the eighth embodiment of the invention.

Eighth Embodiment (FIG. 20):

An eighth embodiment shown in FIG. 20 relates to a case in which the high pressure jetting period TH is changed so as to reduce the deviation ΔΘe to zero when the picking starting time IS reaches the limit, particularly, to a case for setting the high pressure jetting period TH as the total of intermittent periods, thereby changing the intermittent periods, i.e., pulse rates. In each of the first to seventh embodiments, the high pressure jetting period TH is set as a continuous period but in this eighth embodiment, it comprises, for example, an ON period T1 and an OFF period T2.

An arithmetic operation unit 49 and an oscillator 50 change the ON period T1 alone or the OFF period T2 alone or both of the ON period T1 and the OFF period T2 in response to the deviation ΔΘe, thereby reducing the deviation ΔΘe to zero. The operation of the operation instruction device 45 is the same as that in the third embodiment shown in FIG. 9, wherein the arithmetic operation unit 49 changes the pulse rate under the existence of the operation command OP2.

Although the object to be controlled is the weft picking nozzles, it may be the main nozzle 13 alone or the sub-nozzles 14 alone since both of the main nozzle 13 and the sub-nozzles 14 are not necessarily controlled at the same time.

The order for changing the picking starting time IS and that of the high pressure jetting period TH may be made as follows. The high pressure jetting period TH is changed first so as to reduce the deviation to zero, and when the amount of change of the high pressure jetting period TH reaches the limit, then picking starting time IS may be changed to reduce the deviation to zero.

For example, if the controller is structured as shown in FIG. 7, when the change of the high pressure jetting period TH is carried out by changing the high pressure jetting end timing ΘHE, the maximum and minimum values of the high pressure jetting end timing ΘHEmax and ΘHEmin are respectively set in the operation instruction device 45. The air pressure jetting end timing ΘHE instead of the low pressure jetting start timing ΘLS is branched from the deciding device 41 and output to the operation instruction device 45. The operation instruction device 45 outputs the operation command OP2 to the deciding device 41 when the expression of ΘHEmin≦ΘHE≦ΘHEmax is established, and stops the operation command OP2 and outputs the operation command OP1 to the deciding device 40 when the expression of ΘHEmin>ΘHE or the expression of ΘHEmax<ΘHE is established. When the operation command OP2 is stopped, the deciding device 41 holds the high pressure jetting end timing ΘHE at that time.

What is claimed is:

1. A method of controlling a weft picking operation in an air-jet loom, the method comprising:

supplying air under pressure to weft picking nozzles, wherein the air under pressure is supplied to said weft picking nozzles via high and low pressure supply passages for picking the weft, and said high and low pressure supply passages are arranged in parallel with each other;

jetting the air under pressure from the weft picking nozzles so as to pick a weft yarn into a warp shed, said air under pressure being jetted from said weft picking nozzles in cooperation with said high and low pressure air supply passages;

detecting, during the weft picking operation, a deviation between a weft arrival time of the picked weft and a reference weft arrival time; and changing a time of a high pressure jetting period in which air is jetted under high pressure and changing a weft picking starting time so as to reduce the detected deviation to zero in a succeeding weft picking operation.

2. The method of controlling a weft picking operation as claimed in claim 1, further comprising:

changing the picking starting time based on the detected deviation so as to reduce the deviation between the weft arrival time of the picked weft and a reference weft arrival time in a subsequent weft picking operation to zero; and changing the high pressure jetting period so as to reduce any remaining deviation to zero when the amount of change of the picking starting time reaches a limit.

3. The method of controlling a weft picking operation as claimed in claim 1, further comprising:

changing the high pressure jetting period based on the detected deviation so as to reduce the detected deviation in a subsequent weft picking operation to zero; and changing the picking starting time so as to reduce any remaining deviation to zero when the amount of change of the high pressure jetting period reaches a limit.

4. The method of controlling a weft picking operation as claimed in claim 1, further comprising:

dividing the detected deviation into the high pressure jetting period and the picking starting time in accordance with a predetermined ratio; and changing the high pressure jetting period and the picking starting time based on the divided deviation so as to reduce the detected deviation in a subsequent weft picking operation to zero.

5. The method of controlling a weft picking operation as claimed in claim 4, further comprising changing at least one of a high pressure jetting start timing and a high pressure jetting end timing of the high pressure jetting period in order to change the high pressure jetting period.

6. The method of controlling a weft picking operation as claimed in claim 4, further comprising:

jetting, in pulses, the air under high pressure during the high pressure jetting period; and changing the pulse rates of the jetted pulses in order to change the high pressure jetting period.

7. The method of controlling a weft picking operation as claimed in claim 1, further comprising changing at least one of a high pressure jetting start timing and a high pressure jetting end timing of the high pressure jetting period in order to change the high pressure jetting period.

8. The method of controlling a weft picking operation as claimed in claim 1, further comprising:

jetting, in pulses, the air under high pressure during the high pressure jetting period; and changing the pulse rates of the jetted pulses in order to change the high pressure jetting period.

9. The method of controlling a weft picking operation as claimed in claim 1, further comprising setting the high pressure jetting period to be within a low pressure jetting period, and changing a low pressure jetting start timing of the low pressure jetting period in order to change the picking starting time.

10. The method of controlling a weft picking operation as claimed in claim 9, further comprising:

changing the picking starting time based on the detected deviation so as to reduce the deviation to zero in a subsequent weft picking operation; and changing the high pressure jetting period so as to reduce any remaining deviation to zero when the amount of change of the picking starting time reaches a limit.

11. The method of controlling a weft picking operation as claimed in claim 9, further comprising:

changing the high pressure jetting period based on the detected deviation so as to reduce the detected deviation to zero in a subsequent weft picking operation; and changing the picking starting time so as to reduce any remaining deviation to zero when the amount of change of the high pressure jetting period reaches a limit.

12. The method of controlling a weft picking operation as claimed in claim 9, further comprising:

dividing the detected deviation into the high pressure jetting period and the picking starting time in accordance with a predetermined ratio; and changing the high pressure jetting period and the picking starting time based on the divided deviation so as to reduce the detected deviation in a subsequent weft picking operation to zero.

13. The method of controlling a weft picking operation as claimed in claim 12, further comprising changing at least one of a high pressure jetting start timing and a high pressure jetting end timing of the high pressure jetting period in order to change the high pressure jetting period.

14. The method of controlling a weft picking operation as claimed in claim 12, further comprising:

jetting, in pulses, the air under high pressure during the high pressure jetting period; and changing the pulse rates of the jetted pulses in order to change the high pressure jetting period.

* * * * *